US006049994A

United States Patent [19]

Pickett

[11] Patent Number: 6,049,994

[45] Date of Patent: Apr. 18, 2000

[54] COMBINATION HAIR DRYER COVER AND HEAD SHIELD

[76] Inventor: Sharron Pickett, 15411 Birwood, Detroit, Mich. 48238

[21] Appl. No.: 08/994,058

[22] Filed: Dec. 19, 1997

[51] Int. Cl.[7] ..... A45D 20/00

[52] U.S. Cl. ..... 34/99; 34/96

[58] Field of Search ..... 34/96, 97, 98, 34/99, 100

[56] References Cited

U.S. PATENT DOCUMENTS

| | | | |
|---|---|---|---|
| 2,474,165 | 6/1949 | Roberts | 34/99 |
| 3,043,016 | 7/1962 | Miller | 34/99 |

*Primary Examiner*—Henry Bennett
*Assistant Examiner*—Pamela A. Wilson
*Attorney, Agent, or Firm*—Gerald R. Black

[57] ABSTRACT

The combination hair dryer cover and head shield is for use with a hood-type hair dryer and is useful for energy conservation while also protecting the forehead, features and neck of the user from excess heat being emitting from the hair dryer. The apparatus comprises a hood cover and a head shield which are stitched together around the perimeter of a common seam. The apparatus will protect uncovered portions of the patrons' head from heat energy from the hair dryer. The shield cover and the hood cover are each made of a clear plastic material. The hood cover is secured onto the hood by an elastic band and the shield is retained onto the head of the patron by another elastic band. The apparatus is inexpensive to make and readily disposable, thereby providing improved sanitary conditions.

17 Claims, 2 Drawing Sheets

COMBINATION HAIR DRYER COVER AND HEAD SHIELD

FIELD OF USE

The invention relates to a device for use in a beauty salon for drying and setting hair, and more particularly, to a device that directs heat from the hair dryer onto the hair of the patron in an energy efficient manner.

BACKGROUND OF THE INVENTION

The conventional hood hair dryer is outdated for many hair drying applications.

Instead, it is being used primarily as a means to direct heat energy to the hair—in other words, to warm the hair and not necessarily to dry it. When heat is applied with a hair conditioner, hair coloring, or a perm, the styling and conditioning of the hair is enhanced.

U.S. Pat. No. 4,133,052 (Hodgman) discloses a face guard for use with a hooded hair dryer. The face guard is secured about the forehead and is retained onto the back of the head by hook-and-loop fasteners. A first portion of the face guard covers the forehead, eyes, and nose and opposing second portions cover the ears protecting such features from excess heat exhausted from the hair dryer U.S. Pat. No. 4,704,744 (Myers) discloses a neck and face shield to be worn by a person while sitting under a hood-type hair dryer. The shield includes a visor extending around its perimeter so that most of the heat is deflected from the exhausted air away from the face and neck of the patron. The shield is also adjustable with hook-and-loop type fasteners to fit onto heads of various shapes and sizes.

U.S. Pat. No. 5,029,404 (Terrell) discloses an attachable quick dry diffuser complete with a drawstring and hook-and-loop type fasteners which provide adjustment means for various head sizes. The apparatus prevents overheating of the head and face, and reduces drying processing time thereby saving energy.

U.S. Pat. No. 5,218,772 (Dickson) discloses a hair dryer hood conduit which fits onto a person's head and minimizes heat loss. The conduit includes roll-up coverings disposed about the conduit which cover screens to enable temperature adjustment, and a temperature sensor is optional.

While head covers have been used to cover the hair of the patron, these head covers are generally used to enable an even distribution of heat to be applied to all hair to be treated. Such covers have substantial heat losses and can cause substantial discomfort to the wearer.

What is needed is a device that will minimize the amount of time needed to heat the hair of the patron while not wasting heat energy.

What is needed is a device that will be comfortable to the patron and will reduce the noise level during use.

What is needed is a device that is adjustable for various head sizes and fully adaptable for patrons of varying heights.

What is needed is a device that is readily disposable thereby preventing the spread of disease from patron to patron.

What is needed is a device that is easy to use and will not dry the hair of the patron.

What is needed is a device that is inexpensive to make, that is made from conventional materials, and that is disposable after use by each patron for sanitation purposes.

SUMMARY OF THE INVENTION

The combination hair dryer cover and head shield of the present invention prevents the hair from drying out when the perm, hair color, or conditioner is being used on the hair; keeps hair chemicals contained under the cap not on the dryer; keeps the heat on the head and away from the ears or the face; reduces the noise level under the dryer; is energy efficient and requires less processing time; is constructed of durable and reliable materials; is adjustable to fit all head sizes; decreases hair drying time; is inexpensive to manufacture with regard to both labor and materials; and is disposable for sanitary reasons.

The combination hair dryer cover and head shield apparatus of the present invention is primarily for use with a hair dryer, or other heat sources that supply heat energy by convection, but can also be used in other applications such as a hand warmer or a foot warmer. The apparatus includes a hood cover and a heat shield.

One end of the hood cover is mounted during engagement upon the hood of the hair dryer. The heat shield includes one end portion adjustably retained over the scalp and hair, and onto the head of the patron, and the second shield end portion is securely attached to an end of the hood cover. The shield and the cover share a common perimeter, as essentially all of the shield perimeter being attached to essentially the entire perimeter.

The combination of the hood cover and the heat shield protects portions of the head and face that are not covered from heat energy from the hair dryer. To ensure that the thin plastic apparatus of the present invention is not blown off from the hair dryer once the hair dryer is engaged, more than one retainer may be needed. Also, the source cover includes vents through which some excess heat energy is allowed to escape.

A second embodiment of the apparatus of the present invention involves one end of the hood cover being affixed onto the hair-dryer and the other end of the hood cover is placed and retained onto the head of the patron. To ensure that the thin plastic hood cover is not blown off from the hair dryer once the hair dryer is engaged, more than one retaining means may be needed. The first retainer is preferably an elastic band which is mounted within the outer perimeter of the hood, the elastic band being retained thereabout. The second retainer is preferably a flexible strap that is generally normal to the elastic band when positioned about and retained onto the hair dryer hood.

For a more complete understanding of the combination hair dryer cover and head shield of the present invention, reference is made to the following detailed description and accompanying drawings in which the presently preferred embodiments of the invention are shown by way of example. As the invention may be embodied in many forms without departing from spirit of essential characteristics thereof, it is expressly understood that the drawings are for purposes of illustration and description only, and are not intended as a definition of the limits of the invention. Throughout the description, like reference numbers refer to the same component throughout the several views.

DETAILED DESCRIPTION OF THE PREFERRED EMBODIMENTS

Figure 1:
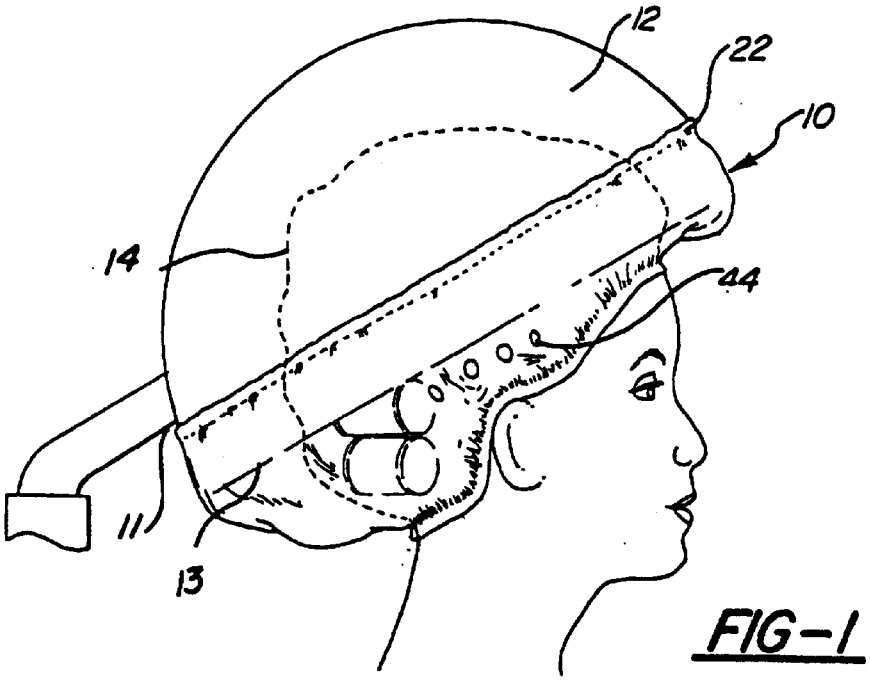
FIG. 1 is a side elevational view of a first embodiment of the combination hair dryer cover and head shield of the present invention as mounted relative to a hood type hair dryer, the head of the patron being within the hair dryer.
Figure 2:
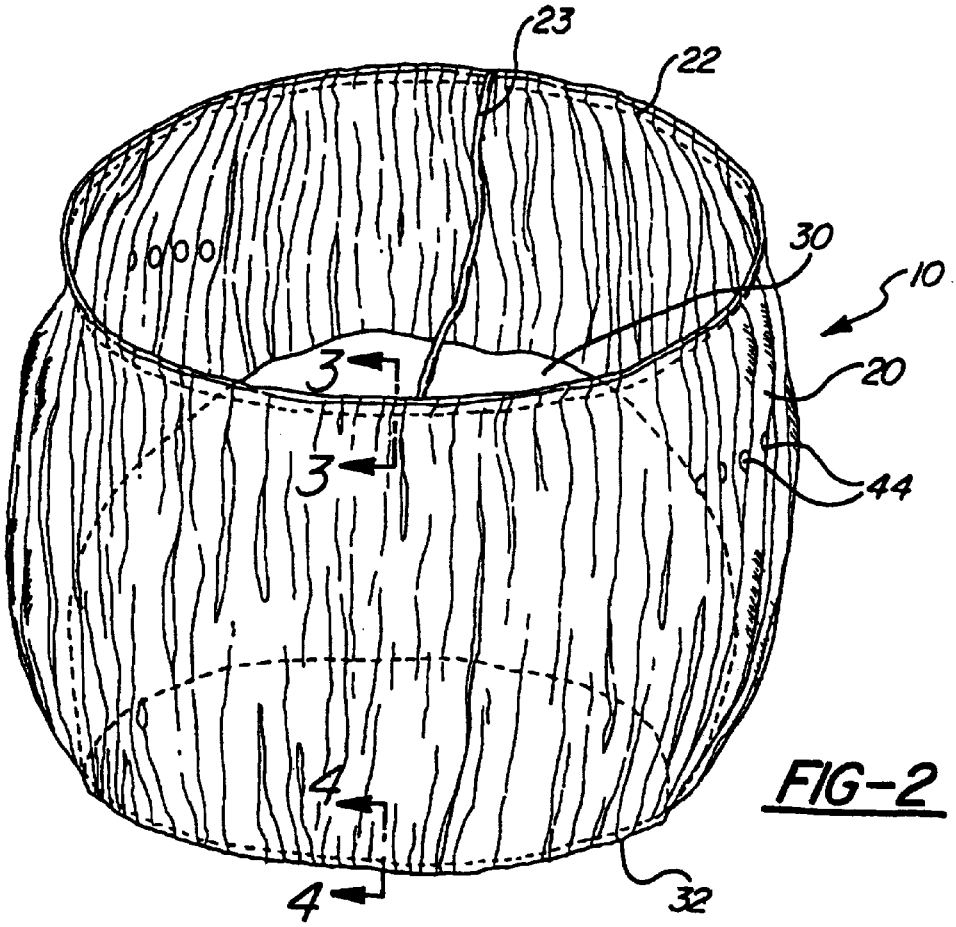
FIG. 2 is a front view of a first embodiment of the combination hair dryer cover and head shield of FIG. 1.

Referring now to the drawings, FIGS. 1 and 2 disclose the first embodiment of the combination hair dryer cover and head shield apparatus [10] of the present invention. The heat direction apparatus [10] is primarily for use with a heat source or hair dryer [11] can also be used in other applications such as a hand warmer or a foot warmer. The apparatus [10] includes a source cover or a hood cover [20] and an object cover or head shield [30].

Figure 5:
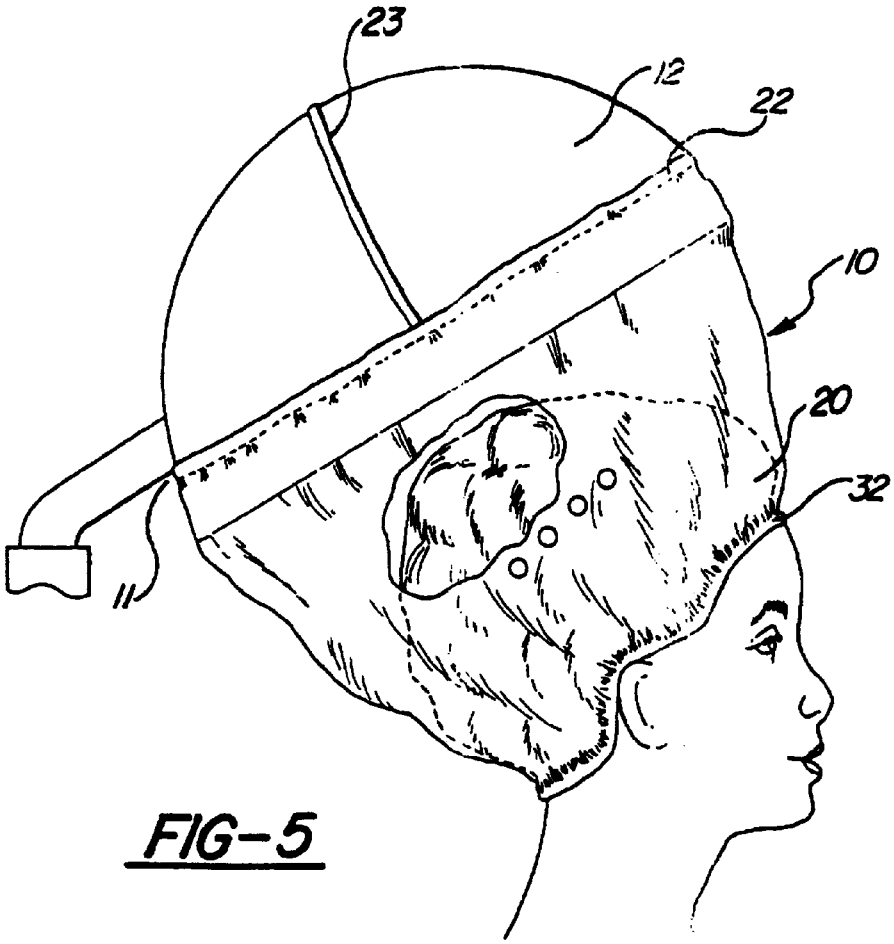
FIG. 5 is a side elevational view of the first embodiment of the combination hair dryer cover and head shield of FIG. 1 as mounted relative to a hood type hair dryer, the head of the patron being within the hair dryer.

Either the head of the patron is positioned within the hood [12] of the hair dryer [11] as shown in FIG. 1, or the head of the patron is removed from the hood [12], as shown in FIG. 5. This enables the apparatus [10] of the present invention to be adaptable for patrons of varying heights, and also enables the patron to be removed from the hood [12], thereby reducing noise levels.

Figure 3:
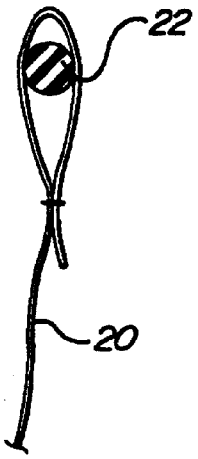
FIG. 3 is a cross-sectional view of the elastic band of the upper portion of the combination hair dryer cover and head shield of FIG. 1.

One end of the hood cover [20] is mounted during engagement upon the exhaust portion [13] of the hood [12] of the hair dryer [11]. The primary hood cover retainer [22] as shown in FIG. 3 can be any conventional fastener, such as tape, hook-and-loop type fasteners, but is preferably an elastic band positioned within the perimeter of the end of the hood cover [20]. The hood cover [20] has a generally cylindrical shape, one end portion [21] of which is affixed to the hair-dryer hood [12] and the other end portion [31] being affixed about the head [14] of the wearer.

The head shield [30] is retained onto the head [14] of the person using the hair dryer [12]. The head shield retainer [32] can be any conventional fastener, such as tape, hook-and-loop type fasteners, but is preferably an elastic band positioned within the perimeter of the end of the head shield [30]. The elastic band may be a conventional rubber band or a rubber band that requires the ends to be tied together.

Figure 4:
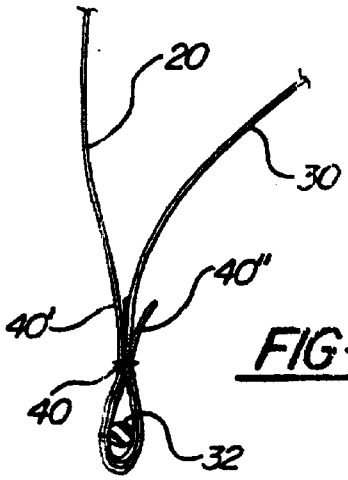
FIG. 4 is a cross-sectional view of the elastic band of the lower portion of the combination hair dryer cover and head shield of FIG. 1.

The head shield [30] is adjustably retained over the scalp and hair, and onto the head [14] of the patron. The shield [30] and the cover [20] share a common perimeter [40], as essentially the entire perimeter [40'] of the hood cover [20] is attached to essentially the entire perimeter [40"] head shield [30] as shown in FIG. 4.

The combination of the hood cover [20] and the head shield [30] protects uncovered portions of the head [14] and face from heat energy from the hair dryer [11]. The hood cover [20] and the head shield [30] are preferably both made from a thin clear or tinted plastic material, having a thickness of between 0.50 and 1.40 millimeters, and more specifically of about 0.70 millimeters. Also, the hood cover [20] and the head shield [30] can be made of different materials depending upon the particular application, To ensure that the apparatus [10] of the present invention is not blown off from the hair dryer [11] once the hair dryer [11] is engaged, more than one retainer may be needed. The first retainer [22] is preferably an elastic band, such as a rubber band, which is mounted within the outer perimeter of the hood [12], the elastic band being retained thereabout. The second retainer [23] is preferably a flexible strap that is generally normal to the elastic band when positioned about and retained onto the hair dryer hood [12].

The hood cover [20] includes vents [44] through which some excess heat energy is enabled to escape. Also, since there are many different types of hooded hair dryers [11], by providing different numbers and configurations of vents [44] of the apparatus [10] is suitable for hair dryers [11] of varying capacities.

To ensure that the thin plastic hood cover [20] is not blown off from the hair dryer [11] once the hair dryer [11] is engaged, more than one retaining means may be needed. The first retainer [22] is preferably an elastic band, such as a rubber band, which is mounted within the outer perimeter of the hood [12], the elastic band being retained about the hood [12]. The second retainer [23] is preferably a flexible strap or rubber band that is generally normal to the primary retainer [22] when positioned about and retained onto the hair dryer hood [12].

A wide variety of other attachment means may be used, including any combination of bands and straps, some being reinforced double or triple bands, and some being double or reinforced straps. Various configurations of hook-and-loop type fasteners may also be used.

While the combination hair dryer cover and head shield [10] of the present invention has been discussed herein in relation to applications involving a hood-type hair dryer [11], it will be clear to those skilled in the art that the principles of the present invention have additional applications. The apparatus [10] may be used as hand and foot warmers in cold weather. Also, the invention may be used by football players and skiers, for example, in subfreezing temperatures to keep hands and feet warm or for more extensive coverage.

It is evident that many alternatives, modifications, and variations of the combination hair dryer cover and head shield [10] of the present invention will be apparent to those skilled in the art in light of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

What is claimed is:

1. A heat directing apparatus for use with a hair dryer and a hair dryer hood for drying hair disposed upon a head of a wearer, the apparatus comprising:

a hood cover having a first and second cover end portion, the first cover end portion being affixed onto the hair-dryer hood by a retainer;

a head shield being adjustably retained onto a portion of the head of the wearer, the head shield being securely attached to the second cover end portion; and means for attaching the hood cover to the head shield;

whereby the combination of the hood cover and the head shield protect portions of the head of the wearer that are not covered from heat energy from the hair dryer.

2. The heat directing apparatus of claim 1, wherein the head shield and the second cover end portion share a common perimeter.

3. The heat directing apparatus of claim 1, wherein the second cover end portion is adjustably retained onto the head of the wearer by an elastic band.

4. The heat directing apparatus of claim 1, wherein the retainer affixing the first cover end portion onto the hair-dryer hood is an elastic band.

5. The heat directing apparatus of claim 1, wherein the head shield and the hood cover are each made of a thin plastic material.

6. The heat directing apparatus of claim 1, wherein the hood cover includes vents through which some excess heat energy is allowed to escape.

7. The heat directing apparatus of claim 1, further comprising a second retaining means for retaining the hood cover onto the hood.

8. A heat directing apparatus for use with a heat source that supplies heat energy by convection to an object to be heated, the apparatus comprising:

a source cover having a first and second source cover end portion, the first source cover end portion being affixed relative to the heat source by an elastic band;

an object cover being adjustably retained by an elastic band onto a portion of an object to be heated, the object cover being securely attached to the second source cover end portion; and means for attaching the source cover to the object cover; whereby, the combination of the source cover and the object cover protect portions of the object to be heated and conserve energy projected from the heat.

9. The heat directing apparatus of claim 8, wherein the source cover and the object cover share a common perimeter.

10. The heat directing apparatus of claim 8, wherein the heat source is a hair dryer.

11. The heat directing apparatus of claim 8, wherein the source cover and the object cover are each made of thin plastic material.

12. The heat directing apparatus of claim 8, wherein the source cover includes vents through which some excess heat energy is allowed to escape.

13. The heat directing apparatus of claim 8, further comprising a second retaining means for retaining the source cover onto the heat source.

14. A heat directing apparatus for use with a hair dryer and a hair dryer hood for drying hair disposed upon a head of a wearer, the apparatus comprising a hood cover made from a thin plastic material, the hood cover having a first and second cover end portion, the first cover end portion being affixed onto a hair-dryer and the second cover end portion being affixed about the head of the wearer, the hood cover including a first means for retaining the first cover end portion onto the hair-dryer and a second means for retaining the first cover end portion onto the hair-dryer, the first and second retaining means ensuring a secure retention by the heat directing apparatus made of the thin plastic hood cover onto the hair-dryer hood.

15. The heat directing apparatus of claim 14, wherein the first retaining means comprises an elastic band which is mounted within the end portion, the elastic band being retained about the hair-dryer hood.

16. The heat directing apparatus of claim 14, wherein the second retaining means comprises an elastic strap that is generally normal to the elastic band when positioned about and retained onto the hair dryer hood.

17. The heat directing apparatus of claim 14, further comprising a head shield having a shield end portion being adjustably retained onto a portion of the hair of the wearer.

* * * * *